United States Patent [19]

Jönsson et al.

[11] Patent Number: 4,813,478

[45] Date of Patent: Mar. 21, 1989

[54] PLATE HEAT EXCHANGER

[75] Inventors: Nils-Åke Jönsson, Staffanstorp; Per Rissler, Skanör, both of Sweden

[73] Assignee: Alfa-Laval Thermal AB, Sweden

[21] Appl. No.: 129,906

[22] PCT Filed: Feb. 20, 1987

[86] PCT No.: PCT/SE87/00085

§ 371 Date: Sep. 4, 1987

§ 102(e) Date: Sep. 4, 1987

[87] PCT Pub. No.: WO87/05383

PCT Pub. Date: Sep. 11, 1987

[30] Foreign Application Priority Data

Mar. 5, 1986 [SE] Sweden ..... 8600993

[51] Int. Cl.[4] ..... F28F 7/00

[52] U.S. Cl. ..... 165/78; 165/166; 165/167

[58] Field of Search ..... 165/78, 166, 167, 164, 165/172, 175, 178

[56] References Cited

U.S. PATENT DOCUMENTS 2,610,834 9/1952 Dalzell ..... 165/78

3,334,399 8/1967 Teeguarden ..... 165/166

4,398,591 8/1983 Bond ..... 165/78

4,499,942 7/1985 Allison ..... 165/78

FOREIGN PATENT DOCUMENTS 666504 2/1952 United Kingdom ..... 165/166

*Primary Examiner*—James C. Yeung

*Attorney, Agent, or Firm*—Davis Hoxie Faithfull & Hapgood

[57] ABSTRACT

A frame or a pressure plate (end plate) has two horizontal sides and two vertical sides and is provided with holes or recesses for fastening means used for clamping heat exchange plates between the end plates. The end plate has only one hole or recess (6*a, b;* 7*a, b;* 8*a, b;* 9*a, b*) at the upper and lower horizontal side, the hole or recess (6*a;* 7*a;* 8*a;* 9*a*) at the upper side being located on one side of the vertical center line (L) and the hole or recess (6*b;* 7*b;* 8*b;* 9*b*) at the lower side being located on the other side of the vertical center line (L). The end plate has at least one hole or one recess (10*a, b*) at each vertical side such that a line between the uppermost hole or recess on each side of the vertical center line forms an angle with the vertical center line, larger than 0° but less than 90°.

8 Claims, 3 Drawing Sheets

PLATE HEAT EXCHANGER

Figure 1:
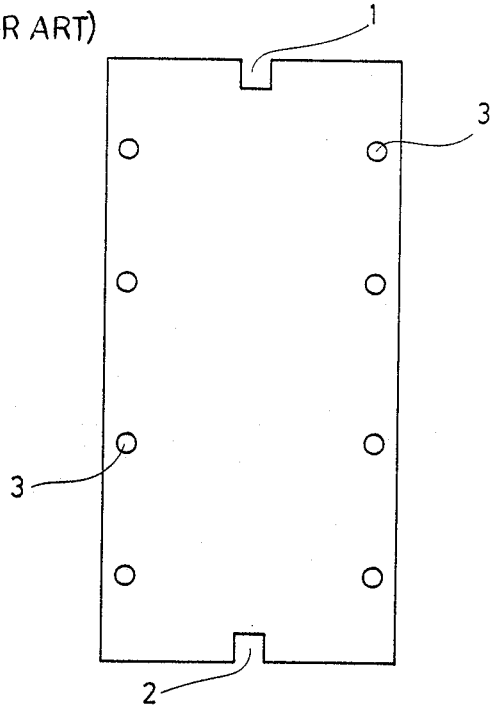
Fig. 1 (PRIOR ART)

This invention relates to a plate heat exchanger having two end plates, i.e. a frame plate and a pressure plate, and heat exchange plates clamped between the two end plates by fastening means positioned on different levels on the end plate and intended to go through holes or recesses in the end plates, each of the end plates having two essentially horizontal sides and two essentially vertical sides and a vertical center line.

A plate heat exchanger comprises a frame provided with a frame plate and a pressure plate (the so-called end plates of the frame) between which a plurality of heat exchange plates are clamped. These heat exchange plates are suspended in the frame by a carrying bar extending between the end plates in the upper part of the frame and a guide bar extending between the end plates in the lower part of the frame. The heat exchange plates are clamped between the end plates by fastening means engaging with holes or recesses in the end plates, which holes and recesses, as a rule, are symmetrically located in these plates. Each fastening means usually comprises a long bolt extending over the whole length of the plate package and co-operating with a nut, the bolt head resting against the frame plate, while the nut is tightened against the pressure plate.

When clamping the plate package between the frame plate and the pressure plate, the latter, by being provided with openings at its upper and lower parts for the carrying bar and the guide bar of the frame, can slide upon these bars and force the plate package against the frame plate which is fastened to the frame.

When forcing the plate package together the number of bolts are adapted to that force with which the plate package shall be tightened and to the medium pressure for which the frame is suited. It has often been so that with regard to the geometry of the end plates and to the symmetrically located holes and recesses in these plates, the number of bolts has been overdimensioned, which has resulted in unnecessary expenses in the form of extra bolts and an unnecessary machining of the end plates. Moreover, the weight of the frame has become unnecessarily high.

This invention aims to remove the problems connected with known technique. That has been brought about by a plate heat exchanger of the kind mentioned by way of introduction which is characterized in that the plate heat exchanger has only one fastening means at the upper horizontal side of the end plate going through a hole or a recess on one side of the vertical center line of the end plate and only one fastening means at the lower horizontal side of the end plate going through a hole or a recess on the other side of the vertical center line of the end plate such that a line drawn between these two fastening means would extend diagonally over the end plate and that the plate heat exchanger has at least one fastening means at each of the two vertical sides of the end plate so located that the uppermost fastening means at one of two vertical sides on the same side of the vertical center line of the end plate as the fastening means at the lower horizontal side of the end plate is closer to the upper horizontal side of the end plate than the uppermost fastening means at the other vertical side on the same side of the vertical center line of the end plate as the fastening means at the upper horizontal side of the end plate.

Figure 7:
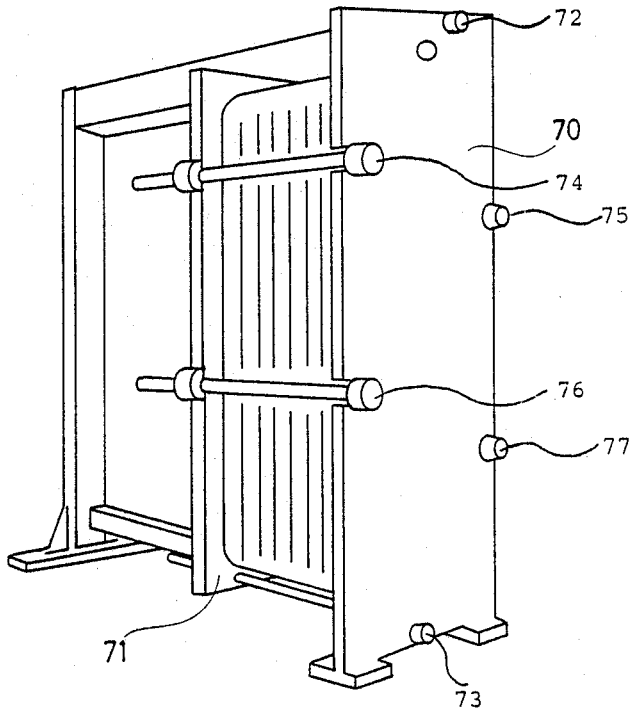

The invention shall be described more closely with reference to the accompanying drawings, in which:

FIG. 1, 2 disclose two known embodiments of a pressure plate,

FIG. 3–6 disclose four different embodiments of a pressure plate according to the invention, and FIG. 7 shows a plate heat exchanger in accordance with the new invention.

As mentioned previously, FIG. 1 shows known technique, in this case a pressure plate which at its upper and lower parts is provided with central openings 1, 2 for the carrying bar and the guide bar. The pressure plate is further provided with eight holes 3 at the edges of its long sides. In this connection each long side is provided with four holes which are uniformly located along the same. These holes are made for the bolts going through the end plates for forcing the plate package together. As is apparent from the figure, there is no hole at the area of the openings 1, 2.

Figure 2:
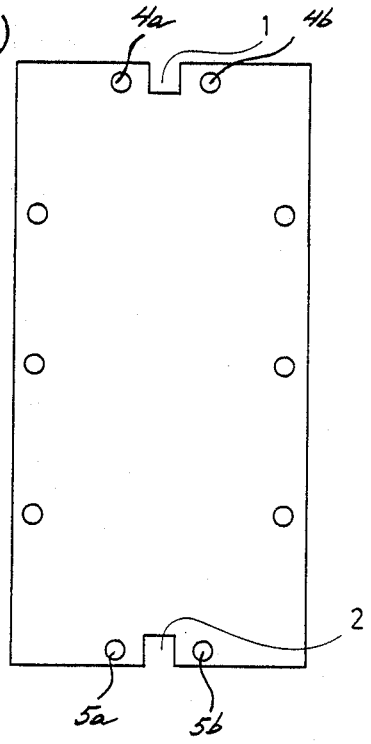
Fig. 2 (PRIOR ART)
Figure 3:
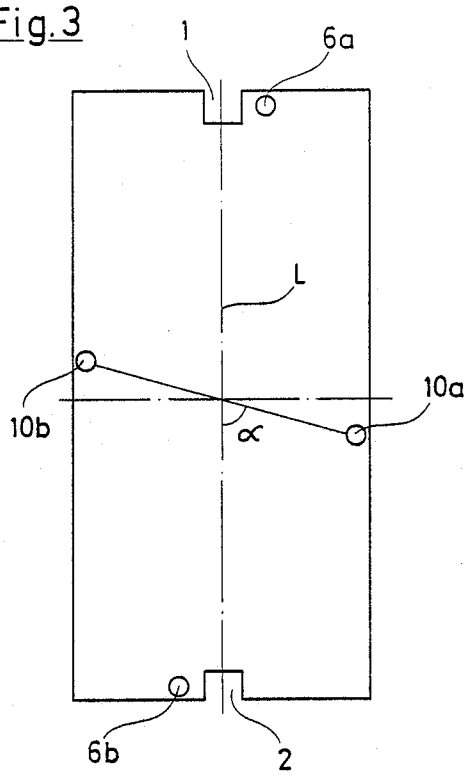

In FIG. 2 another embodiment is disclosed which has come to use lately. This embodiment has bolts also at the area of the openings, so called center bolts. The reason why is that the center bolt arrangement allows that the end plates can be made thinner with regard to deflections and load. Until now a thin material in non-center-bolts-provided end plates has been able to be used only if these end plates have been provided with extra bolts at their two long sides.

Thus, in FIG. 2 there are shown two holes 4*a*, *b* at the upper short side of the plate at the area of the opening 1 and two holes 5*a*, *b* at the lower short side of the plate at the area of the opening 2. For reasons of symmetry one hole is located on each side of the openings 1, 2. Furthermore, each long side of the plate is provided with three holes which are evenly distributed along the long side. That means that the number of holes for the set bolts in the plate is ten.

If in a plate heat exchanger the clamping force achieved by eight bolts of a certain size would be sufficient and if three bolts along each side is necessary, then the number of bolts will be ten, i.e. two more than necessary. The reason why is that for reasons of symmetry two bolts are necessary at each short side of the end plate, one bolt being located on each side of the opening 1, 2. This has the consequence that the cost of manufacturing such a frame will be unnecessarily high. Moreover, the arrangement with the extra bolts results in a higher weight of the frame of the plate heat exchanger. This center bolt arrangement further results in a large asymmetrical distribution of the load on the different bolts, because the center bolts often carry only a small part of the nominal load.

Common for the two embodiments according to FIGS. 1 and 2 is that the holes at one long side of the plate are mirror-inverted in relation to the holes at the other long side of the plate, i.e. the holes on one side of the longitudinal center line of the plate are on the same level as the holes on the other side of the longitudinal center line of the plate.

In FIG. 3–6 there are shown four different embodiments of a pressure plate according to the present invention. Common for all four embodiments is that the pressure plate has two essentially horizontal sides constituting the short sides and two essentially vertical sides constituting the long sides. Moreover, there is a vertical center line that in these cases constitutes the longitudinal center line. Moreover, the plate is provided with an opening 1 at its upper part for a carrying bar and an opening 2 at its lower part for a guide bar, which openings are centrally located in the plate. Common for all four embodiments is also that there is only one hole 6*a, b;* 7*a, b;* 8*a, b;* 9*a, b* at each short side of each plate. In order to prevent a tendency of asymmetrical tightening, these two holes at the short sides of each plate are so located that a line from one of the holes to the other one runs diagonally over the plate, i.e. one hole 6*a;* 7*a;* 8*a;* 9*a* is located on the right-hand side (Alt. I) or the left-hand side (Alt. II) of the upper opening 1 of the plate, while the other hole 6b; 7b; 8b; 9b is located on the left-hand (Alt. I) or right-hand (Alt. II) side of the lower opening 2 of the plate. With regard to the diagonally located holes 6*a, b;* 7*a, b;* 8*a, b;* 9*a, b* the remaining holes on each plate ought to be displaced along the periphery of the plate so that the distance between two adjacent holes will be about the same along the periphery of the plate in order to prevent an asymmetrical load on the plate and in order to obtain optimum loads of the bolts. Thus, in alternative I each hole on the right-hand side of the longitudinal center line of the plate is somewhat displaced downwards in comparison with corresponding holes in plates according to known technique, while each hole on the left-hand side of the longitudinal center line of the plate is somewhat displaced upwards. Thus, in FIG. 3 the hole 10a at the longitudinal edge of the plate on the right-hand side of the longitudinal center line of the plate is located somewhat below the transverse center line of the plate, while the hole 10b at the longitudinal edge of the plate on the left-hand side of the longitudinal center line is located somewhat above the transverse center line of the plate. Due to that fact a line drawn between the holes 10*a,* b forms an angle $\alpha$ with the longitudinal center line L of the plate which is larger than 0° but less than 90°. In frame plates and pressure plates according to known technique these two holes should have been located on the transverse center line of the plate, and besides that the plate should have been provided with two holes in the upper part and the lower part of the plate, which holes should have been symmetrically located with respect to the openings 1 and 2, respectively. By the present invention the same tightening possibilities are principally achieved as in frame plates and pressure plates according to known technique but with a less number of bolts. In spite of this less number of bolts there will be no tendency of asymmetrical tightening.

Figure 4:
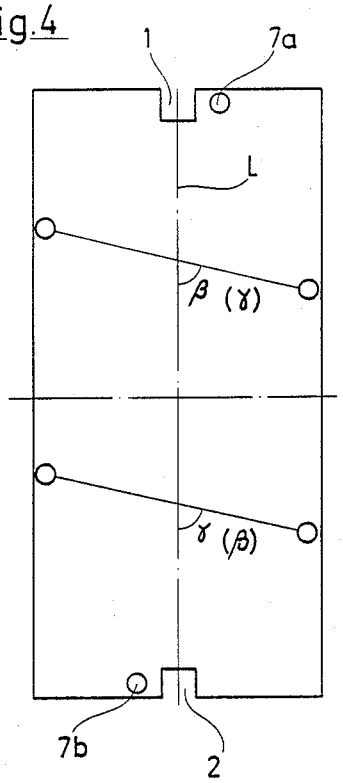
Figure 5:
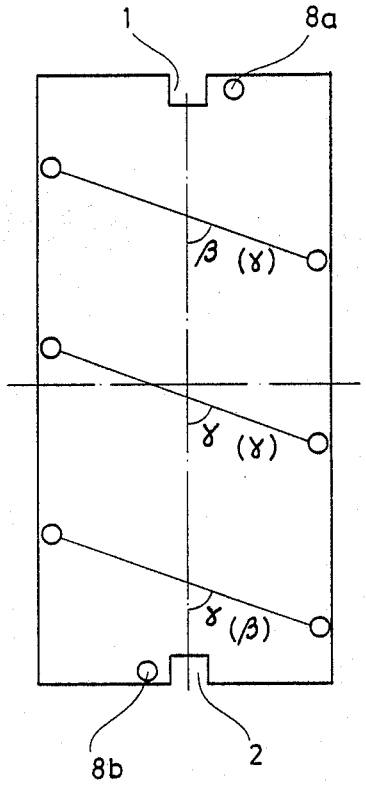
Figure 6:
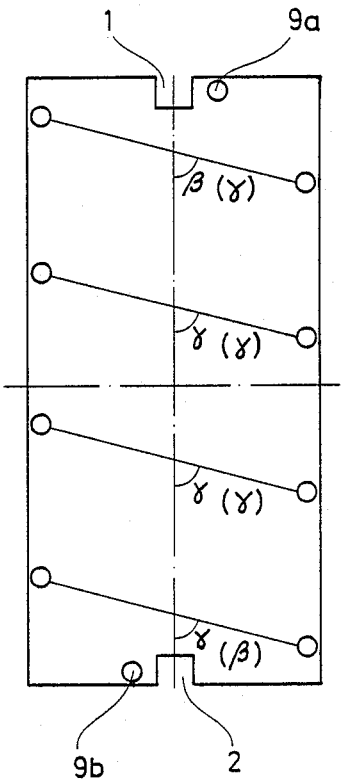

A similar relationship exists between the plates according to FIGS. 4–6 on one hand and plates according to known technique with corresponding holes at the longitudinal edges of the plate on the other hand. In an embodiment of the plate with three holes at the longitudinal edges of the plate, the drawing gives information of the number and the position of the holes in a known plate (FIG. 2) and in a plate according to the present invention (FIG. 5).

In the embodiments according to alternative II, i.e. when the hole 6*a;* 7*a;* 8*a;* 9*a* is located to the left of and adjacent the opening 1, and the hole 6*b;* 7*b;* 8*b;* 9*b* is located to the right of the opening 2, the conditions regarding the position of the holes at the longitudinal edges are opposite to those existing for the embodiments according to alternative I.

According to FIGS. 4–6 each plate is provided with a plurality of holes at each long side. These holes are so located that a line that is drawn between the two holes located uppermost alternatively lowermost on each side of the longitudinal center line L of the plate forms an angle $\beta$ with the longitudinal center line that is larger than 0° but less than 90°, and that a line connecting each nextcoming pair of holes below alternatively above the mentioned hole pair also forms an angle $\gamma$ with the longitudinal center line of the plate that is larger than 0° but less than 90°. In this connection the angle $\beta$ is preferably as large as the angle $\gamma$.

In FIGS. 3–6 the holes 6*a, b;* 7*a, b;* 8*a, b;* 9*a, b* have been located in close proximity of the openings 1 and 2 in the upper and lower parts of the plate. However, these holes can be moved outwards towards the longitudinal edge of the plate but it should be an aim regarding the location of the holes that the distance between two adjacent holes shall be about the same over the whole plate, as is shown in FIGS. 3–6.

In FIGS. 3–6 the present invention has been described in connection with a pressure plate. Of course, the invention is also applicable onto a frame plate, which normally differs from the pressure plate by not being provided with an upper and a lower opening for the carrying bar and the guide bar.

In FIG. 7 there is shown a complete plate heat exchanger in which the idea of the invention is applied onto the frame plate 70 and the pressure plate 71. Each of the two plates has two essentially horizontal sides constituting the two short sides, and two essentially vertical sides constituting the two long sides. Between these two end plates 70, 71 a plurality of heat exchange plates are clamped by a plurality of fastening means 72–77, each of which comprising a long bolt co-operating with a nut, as is the common practice in this field.

As is apparent from FIG. 7, the fastening means are positioned of different levels. Moreover, there is only one fastening means 72 at the upper horizontal side of the frame plate 70 and the pressure plate 71 going through a hole or a recess on one side of the vertical center line of these two plates, and only one fastening means 73 at the lower horizontal side of the two plates 70, 71 going through a hole or a recess on the other side of the vertical center line of the plates such that a line drawn between these two fastening means 72, 73 would extend diagonally over the plates 70, 71.

Moreover, the plate heat exchanger has two fastening means 74, 76; 75, 77 at each vertical side of the end plate 70, 71. The uppermost pair 74, 75 of fastening means is so located that the uppermost fastening means 74 at one of the two vertical sides on the same side of the vertical center line L of the end plate 70, 71 as the fastening means 73 at the lower horizontal side of the end plate is closer to the upper horizontal side of the end plate than the uppermost fastening means 75 at the other vertical side on the same side of the vertical center line L of the end plate as the fastening means 72 at the upper horizontal side of the end plate. That means that a line drawn on the plate 70 from the fastening means 74 to the fastening means 75 is directed obliquely downwards and forms an angle with a vertical center line of the plate 70 which is larger than 0° but less than 90°.

The nextcoming pair 76, 77 of the fastening means is also positioned at the two vertical sides of the plate and is so located that the distance between the two fastening means 74 and 76 on one side of the vertical center line of the plate 70 is about the same as the distance between the two fastening means 75 and 77 on the other side of the vertical center line of the plate 70. That means that a line drawn on the plate 70 from the fastening means 76 to the fastening means 77 is also directed obliquely downwards and forms an angle with the vertical center line of the plate that is larger than 0° but less than 90°.

In the drawings rectangular plates have been disclosd. Of course it is within the scope of the invention to have another form of the plates, for instance square form.

Concludingly, the following advantages with this invention can be mentioned.

- A reduced deflection of the frame plate and the pressure plate
- A reduction of the thickness of the frame plate and the pressure plate
- Evenly distributed loads on the bolts
- An over-dimensioning of the number of bolts is avoided
- A reduced machining of the frame plate and the pressure plate
- A reduced weight of the frame
- A lower production cost.

We claim:

1. A plate heat exchanger having two end plates, each of said end plates having a top edge, a bottom edge, two side edges, and a vertical center line, a plurality of heat exchanger plates and fastening means for clamping said heat exchange plates between the end plates, each of said end plates having recesses to receive said fastening means, each of said end plates having only one fastening means adjacent its top edge and only one fastening means adjacent its bottom edge, said fastening means adjacent the top and bottom edges being positioned on opposite sides of the center line, and each of said end plates also having at least one pair of side fastening means, each of said side fastening means being positioned adjacent one of said side edges, the side fastening means of each pair being vertically offset from one another, the side fastening means on the same side of the vertical center line of the end plate as the fastening means adjacent the bottom edge of the end plate being closer to the top edge of the end plate than the side fastening means on the same side of the vertical center line as the fastening means adjacent the top edge of the end plate.

2. An end plate for a plate heat exchanger, said end plate having a top edge, a bottom edge, two side edges, a vertical center line and recesses to receive fastening means for fastening said end plate to a plurality of heat exchange plates, said end plate having only one recess adjacent its top edge and only one recess adjacent its bottom edge, said recesses adjacent the top and bottom edges being positioned on opposite sides of the center line, said end plate also having at least one pair of side recesses for fastening means, each of said side recesses being positioned adjacent one of said side edges, the side recesses of each pair being vertically offset from one another, the side recess on the same side of the vertical center line as the recess adjacent the bottom edge of the plate being closer to the top edge of the plate than the side recess on the same side of the vertical center line as the recess adjacent the top edge of the plate.

3. The end plate claimed in claim 2 wherein the side recesses are situated such that a line drawn between the side recess closest to the top edge on one side of the plate and the side recess closest to the top edge on the other side of the plate forms an angle with the vertical center line greater than 0° and less than 90°.

4. The end plate claimed in claim 2 wherein the side edges are longer than the top and bottom edges and wherein there are a plurality of recesses along each side edge, a line drawn between the side recess closest to the top edge on one side of the plate and the side recess closest to the top edge on the other side of the plate forming an angle with the vertical center line larger than 0° and less than 90° and a line drawn between the next lower side recesses one each side of the plate forms an angle with the vertical center line which is also greater than 0° and less than 90°.

5. The plate claimed in claim 4 wherein $\beta$ is as large as

6. The end plate claimed in claim 2 wherein the side edges are longer than the top and bottom edges and wherein there are a plurality of recesses along each side edge, a line drawn between the side recess closest to the bottom edge on one side edge and the side recess closest to the bottom edge on the other side edge forming an angle with the vertical center line which is larger than 0° and less than 90°, and a line drawn between the next higher side recesses on either side of the plate forms an angle with the vertical center line which is greater than 0° and less than 90°.

7. The plate claimed in claim 6 wherein $\beta$ is as large as

8. The plate claimed in claim 2 and comprising an opening in the upper part of the plate for a carrying bar and an opening in the lower part of the plate for a support bar, said openings being centrally located in said plate.

* * * * *

UNITED STATES PATENT AND TRADEMARK OFFICE

CERTIFICATE OF CORRECTION

PATENT NO. : 4,813,478

DATED : March 21, 1989

INVENTOR(S) : Jonsson et al.

It is certified that error appears in the above-identified patent and that said Letters Patent is hereby corrected as shown below:

Col. 6, line 25, change "one" to --on--.

Col. 6, line 29, after "as" insert --γ--.

Col. 6, line 42, after "as" insert --γ--.

Signed and Sealed this

Fourth Day of September, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,813,478

DATED : March 21, 1989

INVENTOR(S) : Jonsson et al.

It is certified that error appears in the above-identified patent and that said Letters Patent is hereby corrected as shown below:

Col. 6, line 23, after "angle" insert --β--.

Col. 6, line 26, after "angle" insert --γ--.

Col. 6, line 36, after "angle" insert --β--.

Col. 6, line 39, after "angle" insert --γ--.

Signed and Sealed this

Twenty-ninth Day of October, 1991

*Attest:*

HARRY F. MANBECK, JR.

*Attesting Officer*

*Commissioner of Patents and Trademarks*